US008109063B2

(12) United States Patent
Farmer

(10) Patent No.: US 8,109,063 B2
(45) Date of Patent: Feb. 7, 2012

(54) MOVABLE SEALER

(75) Inventor: Geoffrey A. Farmer, Billericay Essex (GB)

(73) Assignee: Pitney Bowes Ltd., Harlow, Essex (GB)

( * ) Notice: Subject to any disclaimer, the term of this patent is extended or adjusted under 35 U.S.C. 154(b) by 0 days.

(21) Appl. No.: 12/901,940

(22) Filed: Oct. 11, 2010

(65) Prior Publication Data

US 2011/0030313 A1 Feb. 10, 2011

Related U.S. Application Data

(62) Division of application No. 11/876,820, filed on Oct. 23, 2007, now abandoned.

(30) Foreign Application Priority Data

Dec. 21, 2006 (GB) ..... 0625656.4

(51) Int. Cl.
*B65B 11/48* (2006.01)

(52) U.S. Cl. ..... 53/206; 156/441.5; 156/442; 156/1; 156/442.2

(58) Field of Classification Search ..... 156/441.5, 156/442.1, 442.2; 53/206
See application file for complete search history.

(56) References Cited

U.S. PATENT DOCUMENTS 6,790,303 B2 * 9/2004 Allen et al. ..... 156/196
6,948,540 B2 * 9/2005 Brignell et al. ..... 156/360

FOREIGN PATENT DOCUMENTS

EP 1297969 A 4/2003
EP 1676716 A 5/2006

* cited by examiner

*Primary Examiner* — Katarzyna Wyrozebski Lee
*Assistant Examiner* — Daniel Lee
(74) *Attorney, Agent, or Firm* — Brian A. Collins; Charles R. Malandra, Jr.; Steven J. Shapiro

(57) ABSTRACT

An envelope sealing apparatus for sealing an envelope having a main body and a sealable flap foldable about a hinge between the flap and main body, and sealable thereto. The apparatus comprises a feed path along which an envelope can be fed; a driving means associated with the feed path for feeding an envelope along the feed path; a flap securing means cooperative with the driving means to secure an open envelope flap in contact with the driving means; and a flap sealing means cooperative with the driving means to seal the flap to the main body when the driving means drives the envelope in a flap sealing direction along the feed path. A mail piece creation device incorporating such an envelope sealer is further provided, along with corresponding methods.

5 Claims, 11 Drawing Sheets

MOVABLE SEALER

CROSS-REFERENCE TO RELATED APPLICATIONS

This application is a divisional application of prior U.S. application Ser. No. 11/876,820, filed Oct. 23, 2007, which claims the benefit of the filing date of Dec. 21, 2006, for United Kingdom application number 0625656.4, the specifications of which are hereby incorporated by reference.

FIELD OF THE INVENTION

The present invention relates to an envelope sealing apparatus and to a method of sealing an envelope. The invention finds specific application within a mail piece creation device, and to a method of creating a mail piece.

BACKGROUND OF THE INVENTION

It has been known to provide devices for automatically creating a finished mail piece. Such devices range from industrial scale units capable of producing a large throughput (high output) of mail pieces for distribution to a wide audience down to so-called SOHO (Small Office Home Office) mail creation devices having much smaller output capacity.

The functionality of mail piece creation devices typically increases as the size of the device increases. Industrial scale mail piece creation devices represent a production facility in their own right. These facilities are configured to print large numbers of mail items for delivery to individual addressees. Each mail item is printed, collated, accumulated as necessary with other mail items, folded and inserted into an individual envelope. The envelope may bear an address window for displaying an address printed on the mail item, or may be separately addressed, in which case the envelope must be properly addressed to the intended recipient of the enclosed mail items. Once the mail item is inserted into its envelope, the envelope is automatically sealed and processed for delivery. Known devices of this kind are capable of producing individual mail items properly addressed for delivery to large target audiences, perhaps in mail shots of tens or hundreds of thousands of mail pieces, for example as would be required by large service organizations such as banks, utilities companies and governments.

On a more modest scale, SOHO mail piece creation devices have been proposed for home and office use. Such devices are often also referred to as "desktop" mail piece creation devices, although they may, in fact, be floor-standing. Whereas industrial scale mail piece creation devices typically require a dedicated team of highly trained operators in order to maintain and run the production process, SOHO mail piece creation devices are intended to be facile to use and maintain, for operation by non-dedicated staff with a minimum of training. These devices are typically of the scale to produce a few thousand mail pieces per day, and thus find greatest applicability to medium-sized companies reaching a more modest target audience. Whereas the largest mail piece creation devices can achieve the full functionality described above, and are able to process a range of sizes of envelopes and sheets of paper, as well as being able to insert additional items into the envelopes via special inlet feeds, most SOHO mail piece creation devices are typically of a reduced functionality. Usually, this will entail the mail items being preprinted, and then loaded into appropriate inlet feed trays. Similarly, the devices may be restricted to one, or maybe two, acceptable standard sizes for the mail items and envelopes from which the mail pieces are to be created. Furthermore, SOHO mail piece creation devices are typically designed to deliver large numbers of an identical mail piece to many receivers, rather than for creating recipient-specific mail pieces.

Despite having been labeled as SOHO devices, very few existing mail piece creation devices are particularly suited for home use, and it would be very uncommon to find such a device as a piece of household equipment. However, household-related written correspondence continues in vast quantities, despite the recent advances in electronic communication, and a market exists for mail piece creation devices that would be suitable for individual or home use.

The limiting factor in reducing the size of mail piece creation devices for such suitability has been in the need to retain adequate functionality in the device. Within such mail piece creation devices, each particular function in the above-noted process is carried out by separate mechanical system, requiring a corresponding proportion of space within such a machine for each paper handling or envelope handling process that is to be carried out. One such mechanism is the sealer apparatus that is used to close and seal the flap of an envelope, once the contents of the envelope have been inserted.

A typical known envelope sealer receives an envelope along a path, with the open flap of the envelope at the trailing end with respect to the envelope feeding direction. The envelope is typically fed around a curved path portion into a straight insertion section, so that the main body of the envelope is held in an aligned configuration at the insertion location. As the envelope is fed so that its main body rests within the insertion chamber, it is halted at a position where the open flap remains partially within the curved path preceding the straight insertion chamber, to thereby hold the envelope in an open configuration, with the mouth of the envelope held open. Mail items can then be inserted into the envelope, into the open mouth. To assist in the insertion operation, insertion fingers may be inserted into the mouth of the envelope, to assist in guiding a mail item there into, while the flap is usually held securely in the open configuration, typically by a roller pair located in the curved path.

Once the mail item has been inserted into the envelope, the envelope must typically be fed further along the feed path, to bring the hinge between the envelope flap and the main body into line with a sealing roller pair. The envelope is then fed hinge-first through the nip of the sealing roller pair, to close the flap to the main body, thereby sealing the envelope. Where a traditional gum-sealed envelope is to be used, a moistener is provided during this operation, to moisten the gum so that the envelope flap will seal.

Due to the requirement for further transporting the envelope to bring the hinge into alignment with feed rollers, and in order to feed the envelope hinge-first into the roller nip, such a system is unsuitable for sealing envelopes containing very thick or non-flexible mail items, due to the need for the mail item to pass around a curved path so as to enter the roller nip hinge-first. Moreover, the various transporting, flap holding and flap sealing operations, including, where applicable, a flap moistening operation, require a complex series of mechanical feed devices for transporting and feeding the envelope and contents, resulting in fairly large and complex mechanical arrangements.

SUMMARY OF THE INVENTION

According to a first aspect of the present invention, there is provided an envelope sealing apparatus for sealing an envelope having a main body and a sealable flap at one end of the main body foldable about a hinge between the flap and main body, the flap being sealable to said main body under applied pressure when folded about said hinge into contact with the main body, the apparatus comprising: a feed path along which an envelope can be fed; driving means associated with said feed path for, at least in part, feeding an envelope along said feed path; flap securing means cooperative with said driving means to secure an open envelope flap in contact with the driving means; and flap sealing means cooperative with said driving means to seal the flap to the main body when the driving means drives the envelope in a flap sealing direction along the feed path, wherein said driving means is movable from a flap securing position to a flap sealing position, the driving means being operable, in use of the sealing apparatus: (i) to secure an open envelope flap in contact therewith cooperatively with said flap securing means; (ii) to move from the flap securing position to the flap sealing position with the flap secured in contact therewith, so as to at least partially fold the flap about the hinge; and (iii) thereafter to drive the envelope in the flap sealing direction along the feed path, so as to seal the flap to the main body by applying pressure cooperatively with said flap sealing means.

In preferred embodiments said driving means is movable from a flap securing position on one side of the feed path to a flap sealing position on the other side of the feed path.

In further preferred embodiments, said driving means and said flap securing means may be mounted on a common securing support structure, so that as the driving means moves from the flap securing position to the flap sealing position, the flap securing means is supported to effect a complementary motion to ensure that an envelope flap thereby secured is maintained in contact with the driving means through at least a substantial portion of the motion. Similarly, said driving means and said flap sealing means may be mounted on a common sealing support structure, so that as the driving means moves from the flap securing position to the flap sealing position, the flap sealing means is supported to effect a complementary motion to ensure that, at the flap sealing position, an envelope driven in the flap sealing direction along the feed path by the driving means is subjected to an applied pressure.

Embodiments of such an envelope sealing apparatus may further comprise a moistener adjacent to the flap sealing position, the moistener being configured and arranged to be capable of applying moisture to a portion of the flap prior to or during the envelope being driven in the flap sealing direction along the feed path.

Typical embodiments of such an envelope sealing apparatus may comprise an envelope entry path, separate from the envelope feed path, along which envelopes are received into the sealing apparatus, wherein, with the driving means at the flap securing position, the driving means and flap securing means are configured cooperatively to secure the flap at a location along the envelope entry path.

Further embodiments of the sealing apparatus may usefully comprise a flapper mechanism configured to unfold about the hinge the closed unsealed flap of an envelope received into the sealing apparatus with a closed unsealed flap, thereby to ensure that the envelope flap is open to be secured cooperatively by the flap securing means and the driving means at the flap securing position. In most useful arrangements the flapper mechanism will be located along an envelope entry path, to unfold the closed unsealed envelope flap at a location upstream of the location along the entry path where the driving means and flap securing means are configured cooperatively to secure the flap as the envelope is received into the apparatus.

Even further preferred embodiments comprise an insertion location, wherein the main body of an envelope extends at least partially into the insertion location when the open flap of the envelope is cooperatively secured by the flap securing means and the driving means at the flap securing position and the envelope is thereby held open for items to be inserted into the main body of the envelope. In such embodiments, the envelope sealing apparatus may preferably further comprise an insertion frame including one or more insertion fingers arranged for insertion into the opening of an envelope held open at the insertion location, thereby to contribute to holding the envelope open for the entry of items into the envelope main body. Moreover, in embodiments including an envelope entry path as described above, then, at the flap securing position, the driving means is preferably arranged to engage an envelope received along the entry path and to drive the envelope along the entry path so that the main body extends at least partially into the insertion location.

In yet further preferred embodiments said driving means comprises a driven roller movable from the flap securing position to the flap sealing position. In one preferred configuration the flap securing means includes a securing idler roller in cooperative engagement with the driven roller, the securing idler roller being mounted on a common securing support structure as described above; and said securing support structure is configured so that as the driven roller moves from the flap securing position to the flap sealing position the securing support structure rotates about an axis collinear with the driven roller axis to cause the securing idler roller to roll around at least a portion of the outer circumference of the driven roller, thereby to maintain a flap securely in contact with the driven roller as the driven roller moves. Similarly, said flap sealing means may include a sealing idler roller in cooperative engagement with the driven roller and defining a sealing nip between the driven roller and the sealing idler roller, the sealing idler roller being mounted on a common securing support structure as described above, with said sealing support structure configured so that as the driving means moves from the flap securing position to the flap sealing position, with a flap secured in contact with the driving means by said flap securing means, the sealing nip is brought into alignment with the feed path and substantially into engagement with the at least partially folded hinge.

In still further preferred embodiments, the apparatus comprises a trapdoor forming at least a portion of the feed path, the trapdoor being mounted in proximity to the driving means and being displaceable from an envelope guiding position to a retracted position, thereby to allow the driving means to move from the flap securing position to the flap sealing position. In such embodiments, the trapdoor may be mounted on a trapdoor support frame, the trapdoor support frame being attached at least at one end to a support frame of the driving means, thereby to cause displacement of said trap from the envelope guiding position to the retracted position as the driving means moves from the flap securing position to the flap sealing position.

The present invention further provides a mail piece creation device: for automatically inserting mail items into an envelope and automatically sealing the envelope, comprising: an envelope sealing apparatus according to any combination of the preferred embodiments set out above.

According to a second aspect of the present invention, there is provided a method of sealing an envelope having a main body and a sealable flap at one end of the main body foldable about a hinge between the flap and main body, the flap being sealable to said main body under applied pressure when folded about said hinge into contact with the main body, the method comprising the steps of: providing an envelope to a flap securing location with the flap open; securing the flap in contact with driving means at the flap securing location, at least partially folding the flap about the hinge by moving the driving means with the flap secured in contact therewith to a flap sealing position, and driving the envelope with the driving means in a flap sealing direction along a feed path, and applying pressure cooperatively with flap sealing means as the envelope is driven, so as thereby to seal the flap to said main body.

In the above method, the step of providing an envelope to a flap securing location with the flap open preferably includes opening the flap of a closed unsealed envelope before providing the envelope to the flap securing location. Furthermore, the step of providing an envelope to a flap securing location with the flap open preferably includes providing the envelope along an entry path with the main body trailing the flap.

In a preferred embodiment of the method, the step of providing an envelope to a flap securing location with the flap open includes providing the flap to the flap securing location so that the main body extends into an insertion location; and the step of securing the flap in contact with driving means at the flap securing location includes holding the envelope open so that items may be inserted into the envelope main body.

In a further preferred embodiment of the method, the step of at least partially folding the flap about the hinge by moving the driving means with the flap secured in contact therewith to a flap sealing position includes moving the driving means from one side of the feed path to the other side of the feed path.

In yet further preferred embodiments of the method, the step of at least partially folding the flap about the hinge by moving the driving means with the flap secured in contact therewith to a flap sealing position includes moving the securing means relative to the driving means in order to maintain the flap secured in contact with driving means at least substantially entirely to the flap sealing position.

In more preferred embodiments of the method, the step of securing the flap in contact with driving means at the flap securing location further includes inserting envelope opening means at least partially into the main body in order to hold the envelope open for the insertion of items into the main body.

In even more preferred embodiments of the method, the step of at least partially folding the flap about the hinge by moving the driving means with the flap secured in contact therewith to a flap sealing position includes moving the flap sealing means so as to align the flap sealing means with the feed path. Preferably, the step of at least partially folding the flap about the hinge by moving the driving means with the flap secured in contact therewith to a flap sealing position includes substantially engaging the hinge with the flap sealing means.

Even further preferred embodiments of the method further comprise the step of moistening at least a portion of the flap, before or during the step of driving the envelope with the driving means in a flap sealing direction along a feed path, and applying pressure cooperatively with flap sealing means as the envelope is driven, so as thereby to seal the flap to said main body.

In yet more preferred embodiments, the step of driving the envelope with the driving means in a flap sealing direction along a feed path, and applying pressure cooperatively with flap sealing means as the envelope is driven, so as thereby to seal the flap to said main body, includes driving the envelope through a sealing nip of a sealing roller pair.

In particularly preferred embodiments, the method is carried out automatically by an envelope sealing apparatus capable of applying the method to one or a plurality of envelopes sequentially.

In still further preferred embodiments, the step of at least partially folding the flap about the hinge by moving the driving means with the flap secured in contact therewith to a flap sealing position further includes displacing at least a portion of a guide forming part of the feed path, thereby to allow the driving means to move to the flap sealing position.

The present invention further provides a method including any combination of the methods set out above, and further comprising the step of inserting at least one mail item into the open envelope before the step of at least partially folding the flap about the hinge by moving the driving means with the flap secured in contact therewith to a flap sealing position.

Embodiments of the present invention advantageously can provide a sealing apparatus that is useful for sealing envelopes containing thick or non-flexible mail items therein. Embodiments of the invention may also advantageously provide a sealing apparatus having a reduced size and being of relatively simple mechanical complexity, thereby facilitating incorporation of such an apparatus into a mail piece creation device.

The mail piece creation devices provided according to the invention can be of reduced size and complexity, as well as being capable of creating mail pieces that include thicker or non-flexible mail items.

Embodiments of the methods of the invention can achieve the aforementioned advantages when applied to a suitable sealing apparatus or mail piece creation device.

BRIEF DESCRIPTION OF THE DRAWINGS

To enable a better understanding of the present invention, and to show how the same may be carried into effect, reference will now be made, by way of example only, to the accompanying drawings, in which.

DETAILED DESCRIPTION OF THE INVENTION

Figure 1:
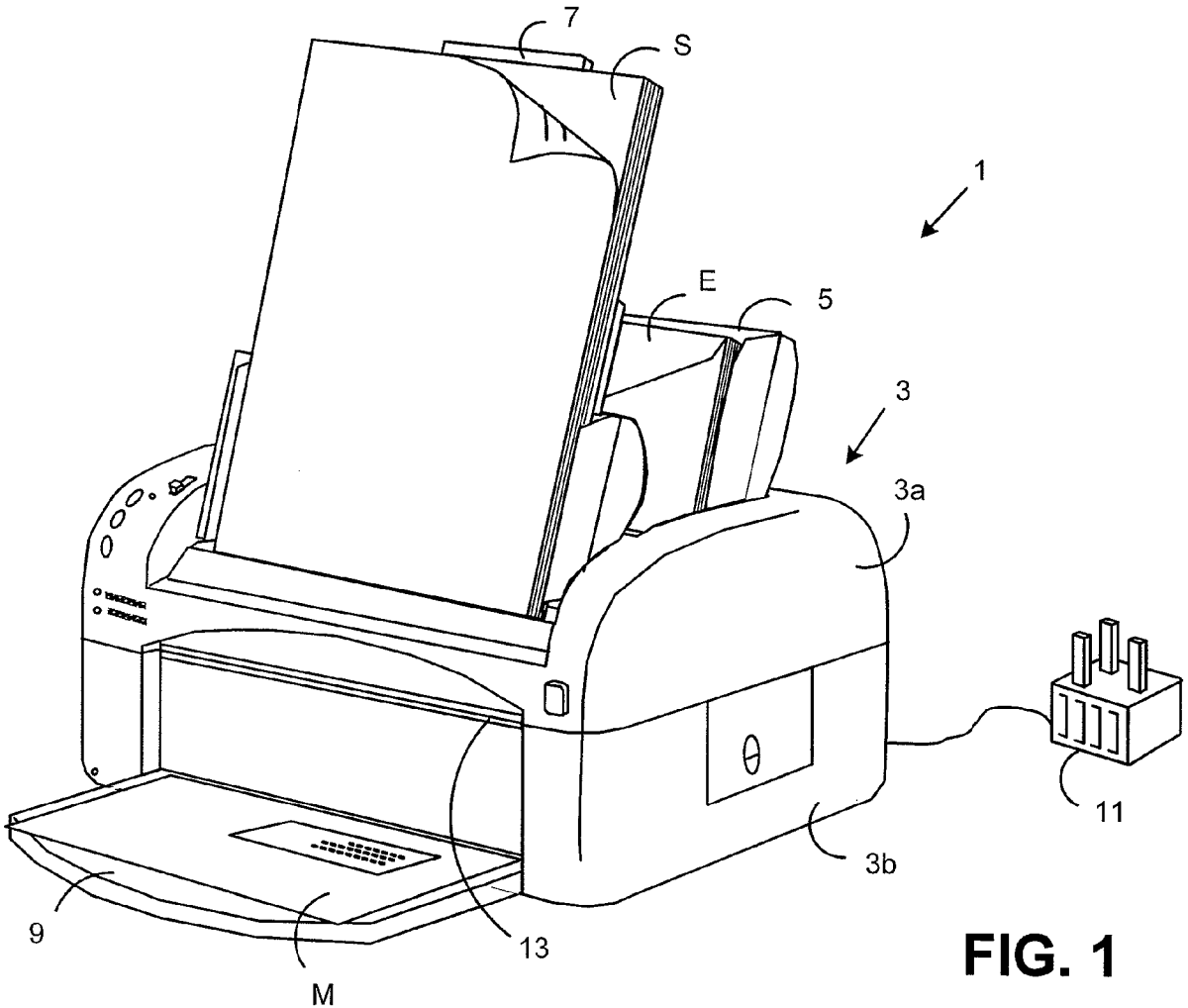
FIG. 1 is an external perspective view of a mail piece creation device loaded with paper and envelopes.

FIG. 1 shows a mail piece creation device 1, loaded with a stack of sheets S held in a sheet feed tray 7 and a plurality of envelopes E held in an envelope feed tray 5. The mail piece creation device 1 is a desktop mail piece creation device, of an equivalent or similar size to typically known desktop printers for personal or home use. The mail piece creation device 1 is generally contained within a housing 3, from which project the sheet feed tray 7 and envelope feed tray 5. At the front of the mail piece creation device 1, there is provided a mail piece collection tray 9, onto which completed mail pieces M can be received from mail piece ejection opening 13. Power is supplied to the mail piece creation device 1 via a typical power supply cable 11, configured to fit into the socket of a local electrical power supply. As shown in FIG. 1, the housing 3 is formed from an upper section 3*a* and a lower section 3*b*, which can be opened about a hinge at the rear of the machine, to gain access to the internal paper handling feed paths of the mail piece creation device 1, for clearing jammed envelopes and paper sheets. As is also suggested by the illustration in FIG. 1, the mail piece collection tray 9 is pivotally mounted to the lower housing section 3*b* to fit within a complementary recess in the housing 3, for storing and packaging the device in a compact configuration.

Figure 2:
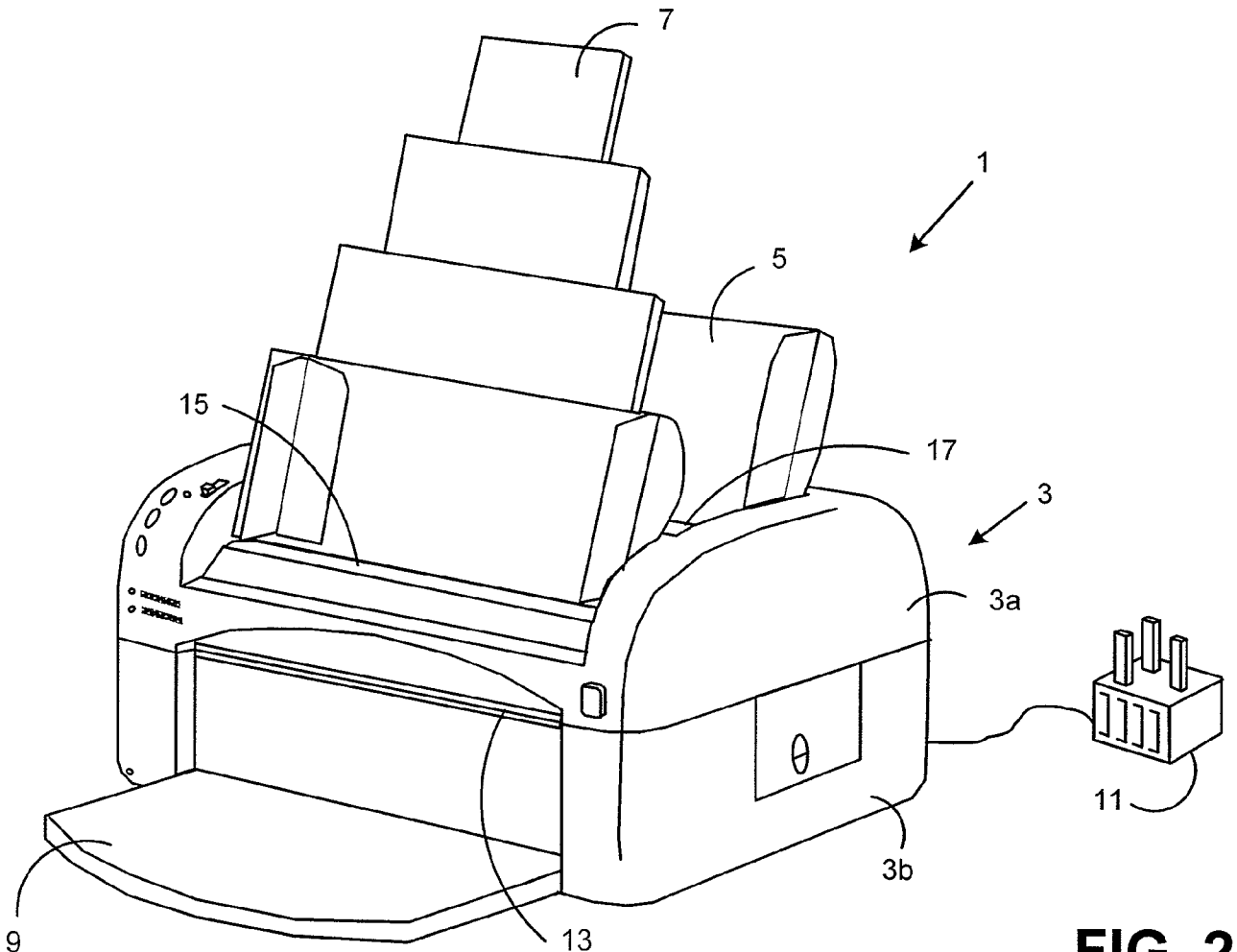
FIG. 2 is an external perspective view of the mail piece creation device of FIG. 1 in its unloaded state.

Referring to FIG. 2, the mail piece creation device 1 of FIG. 1 is shown, absent the loaded sheets S and envelopes E, and finished mail piece M. As can be seen, sheet feed tray 7 feeds sheets into the mail piece creation device 1 through sheet insertion opening 15, while envelopes held in the envelope feed tray 5 are fed into the mail piece creation device 1 through envelope insertion opening 17. As well as mail piece collection tray 9 being retractable, as noted above, sheet feed tray 7 is also telescopically retractable from the position shown in FIG. 2, to reduce the external configuration of the mail piece creation device 1. Both sheet feed tray 7 and envelope feed tray 5 may also be pivotally mounted to the upper housing section 3*a*, for rotation between a retracted low-profile position and the unretracted operational position of FIG. 2. Furthermore, the sheet feed tray 7 and envelope feed tray 5 may be removable, if required for storage or transport.

Figure 3:
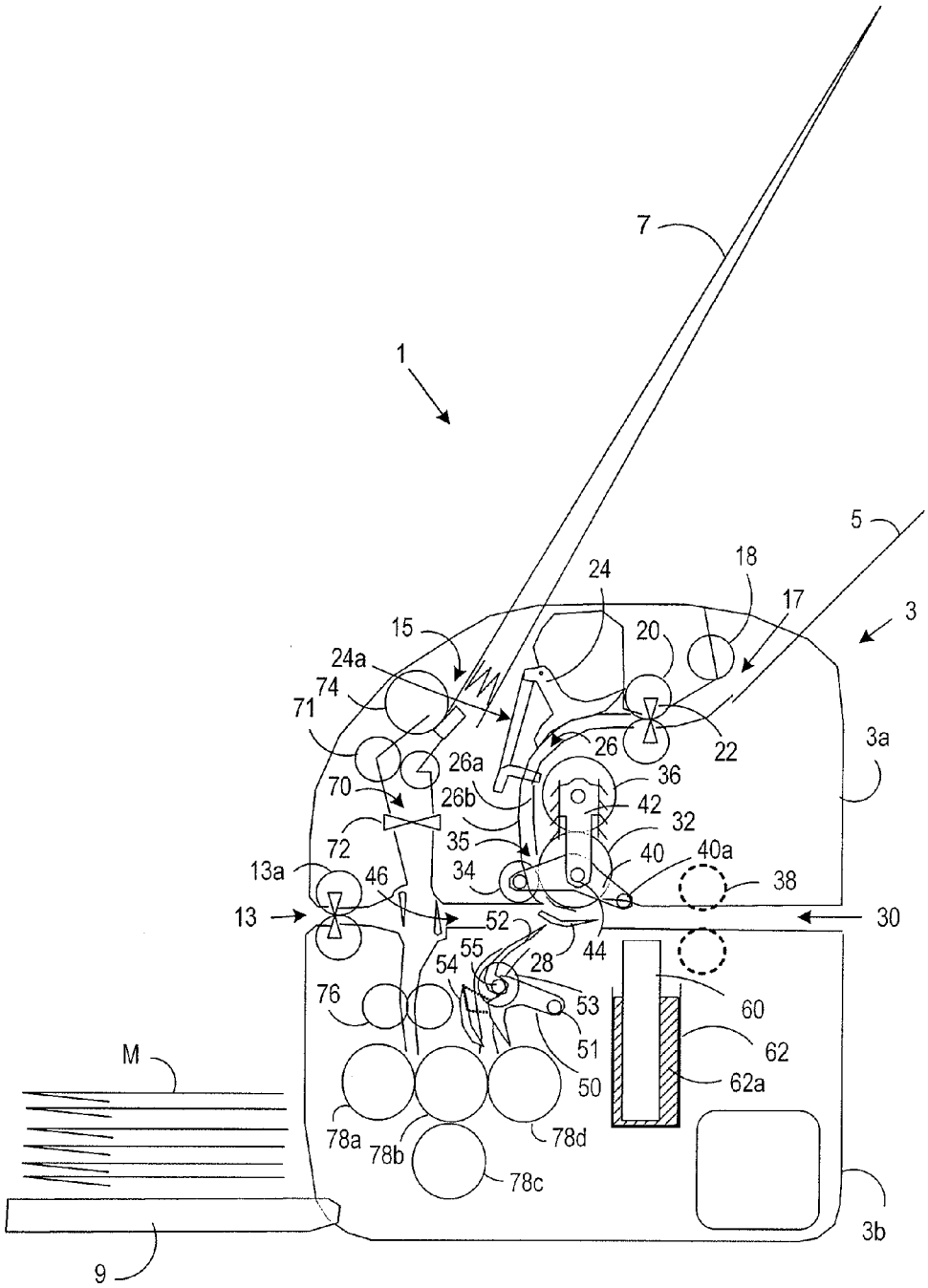
FIG. 3 shows an internal cross-sectional view, schematically depicting the main internal components of the mail piece creation device of FIGS. 1 and 2.

FIG. 3 shows the main internal components of the mail piece creation device 1, in schematic form, in cross-sectional view.

As shown, the mail piece creation device includes a sheet feed tray 7 which delivers sheets held in a stack on the sheet feed tray to a sheet inlet separator 74. The sheet inlet separator comprises a roller and separator block, as commonly known, for feeding sheets individually one-at-a-time into the sheet insertion opening 15. Sheets fed into the sheet insertion opening 15 are fed into a sheet inlet feed path 70, where they are detected by sheet inlet sensors 72. Sheets are driven along the sheet inlet feed path 70 by a pair of feed rollers 71. Sheets fed along the sheet inlet feed path 70 pass into a sheet folding location, where they are received by sheet folder feed roller pair 76. The sheets are then fed into the sheet folder formed by sheet folder rollers 78*a*, 78*b*, 78*c* and 78*d*. As a sheet is fed between the first pair of rollers 78*a* and 78*b*, the sheet leading end is halted (for example in a buckle chute), causing the sheet to buckle. The buckle is fed between the second roller pair 78*b* and 78*c*, thereby creating a fold as the buckle passes through the nip between rollers 78*b* and 78*c*. The sheet thus folded is typically formed with the fold one third of the length along the sheet. As the sheet is then fed through the second roller pair 78*b* and 78*c*, it is again halted at the leading end (now formed by the fold), causing the sheet to buckle at a different location. The second buckle is now fed between the third roller pair 78*b* and 78*d*, to cause a second, further fold in the sheet, typically two thirds of the length down the sheet. In the depicted arrangement of rollers 78*a*, 78*b*, 78*c* and 78*d*, a so-called C-fold is produced, as known in the art, although the rollers may be operated to form a so-called Z-fold, if preferred. For simplicity, since such buckle folders are known in the art (see, for example, EP1 634 840 A1, which discloses a similar sheet folding arrangement), further description of the sheet folding apparatus is omitted. Other sheet folding mechanisms are known in the art, and may be used as appropriate to the particular application.

Turning now to the envelope handling portion of the mail piece creation device 1, envelopes are held in a stack on the envelope feed tray 5. A feeder/separator 18 similar to the sheet inlet separator 74 is provided to feed envelopes one-at-a-time into the envelope insertion opening 17. The envelopes fed into the envelope insertion opening 17 are received by a roller pair 20, and detected by envelope inlet sensor 22. The envelope inlet feed roller pair feeds the envelope, with the sealed end first, along envelope inlet feed path 26 formed by envelope inlet feed path guide plates 26*a* and 26*b*. Just beyond the envelope inlet feed roller pair 20 is located a flapper 24 for opening the flap of an envelope that is fed into the mail piece creation device with the flap closed. Flapper 24 is actuated by a flapper link mechanism 24*a*.

Further along the envelope inlet feed path 26 there is a flap securing location at which a drive roller 32 and a securing roller 34 form a flap securing nip 35. Beyond the flap securing location there is a trap door 28, which forms a shaped guide panel of the feed path, to direct the envelope into an insertion location 30, where the main body of the envelope can be retained in a straight configuration. Insertion feed roller pair 38 is provided to assist with receiving and feeding an envelope into and out from the insertion location 30. A common securing support frame 40 links drive roller 32 and securing roller 34, to thereby maintain these rollers in engagement, to form the securing nip 35 there between. The securing support frame 40 is rotatable about a pivot 40*a*. The drive roller 32 is also mounted on a sealing support frame 42, to which a sealing roller 36 is commonly mounted, preferably biased into engagement with the drive roller 32.

Beneath the trap door 28, there is provided an insertion frame 50, mounted to be rotatable around a pivot 51. The insertion frame 50 includes insertion fingers 52 that are spring-mounted to be rotatable on the insertion frame 50 about a further pivot point 55. The insertion frame is mounted so that as it rotates around pivot 51, insertion fingers 52 extend to displace trap door 28 (also about a pivot), forcing the insertion fingers into the insertion location 30, whereby they can extend into the open mouth of an envelope held in the insertion location. An insertion drive roller 53 is provided to assist in feeding items into the mouth of the envelope with the insertion fingers inserted therein. Furthermore, insertion frame 50 includes insertion guide 54 that can direct folded sheets from the sheet folding location along a path between the insertion fingers 52 and trap door 28, to be driven into an envelope held in the insertion location 30 by a driving force from the drive roller 53. By mounting drive roller 53 and insertion fingers 52 to be rotatable about a common axis, or closely spaced axes, items to be inserted into the envelope may be assuredly driven fully into the envelope from a position immediately adjacent to the open mouth of the envelope.

Below the insertion location, there is provided a moistener wick 60, held within a container 62 of moistening agent 62*a*. The moistener wick is located so that, during a sealing operation, it will moisten the gum portion of an envelope flap, to thereby seal the envelope when the flap is closed against the envelope main body.

Formed mail pieces are fed out of the mail piece creation device 1 by feeding them along feed path 46, for ejection out of the mail piece ejection opening 13, under the influence of mail piece ejection roller pair 13*a*.

More detailed description of the operation of mail piece creation device 1 will now be given with reference to FIGS. 4-10.

Figure 4:
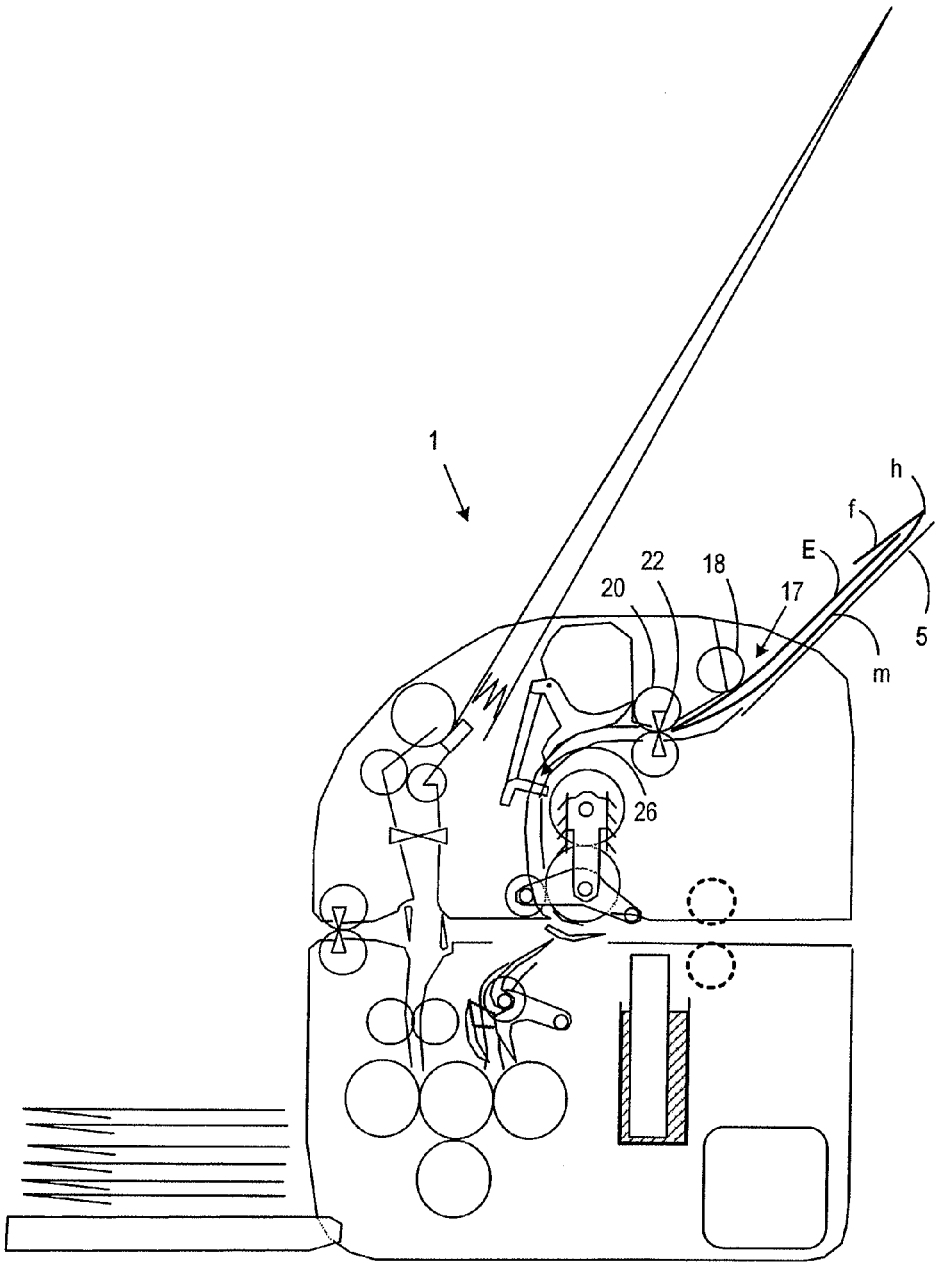
FIG. 4 is an internal cross-sectional view of the mail piece creation device of FIG. 1, as an envelope is fed into the device.

As shown in FIG. 4, an envelope E has a main body m and a flap f joined to one another along a hinge h. The envelope is loaded on the envelope feed tray 5 either singly or in a stack, with the flap end at the trailing edge. As shown in FIG. 4, the envelope is fed by separator roller 18 into the mail piece creation device 1, into the envelope insertion opening 17, with the flap in the closed position (i.e., folded at hinge h). The single envelope E is fed into the envelope insertion opening 17, where it is detected by inlet sensor 22, and received by inlet feed roller pair 20, at the inlet to envelope inlet feed path 26.

Figure 5:
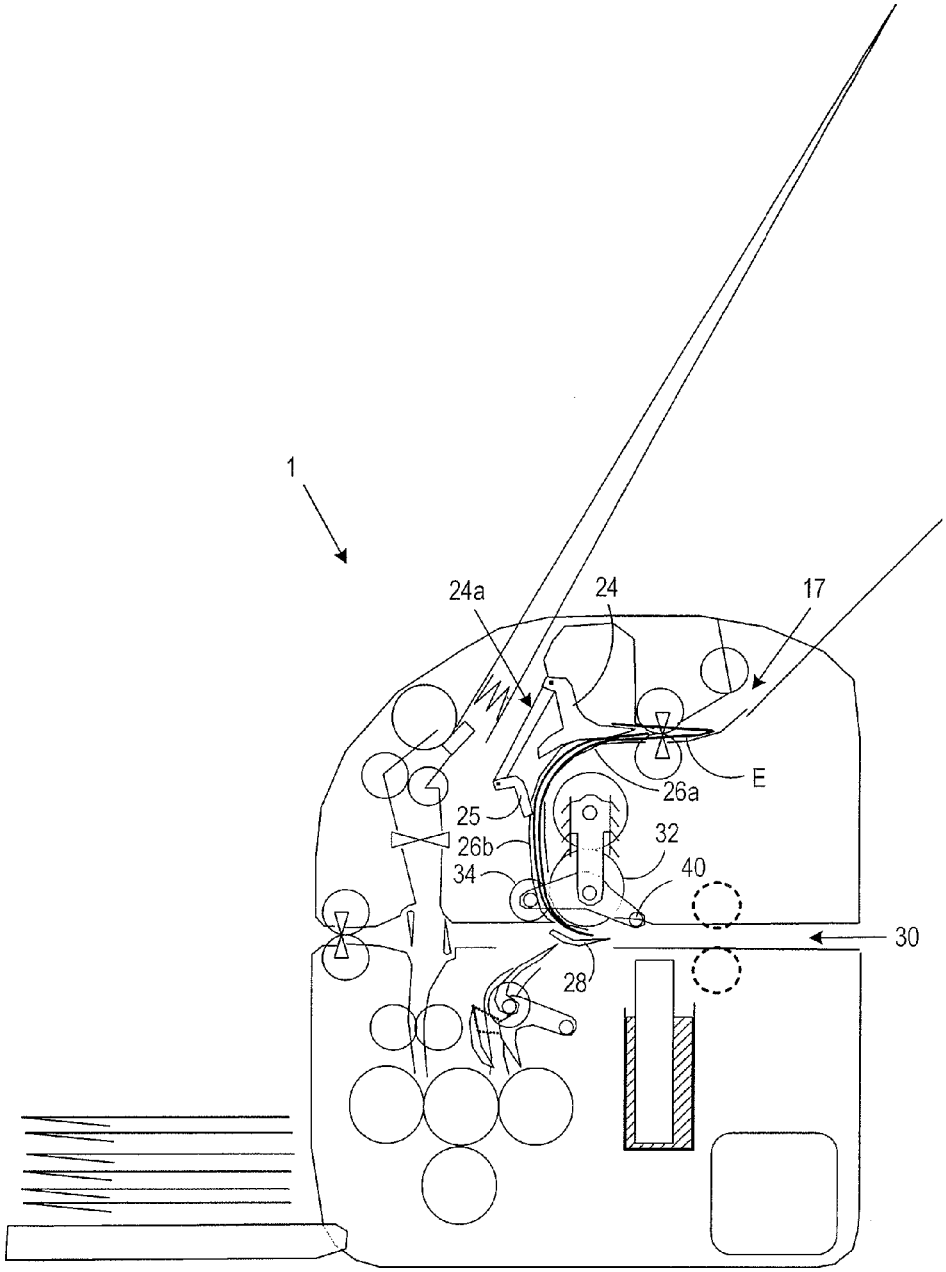
FIG. 5 is an internal cross-sectional view of the mail piece creation device of FIG. 1, showing the flap of an envelope being opened as the envelope is fed into the device.
Figure 6:
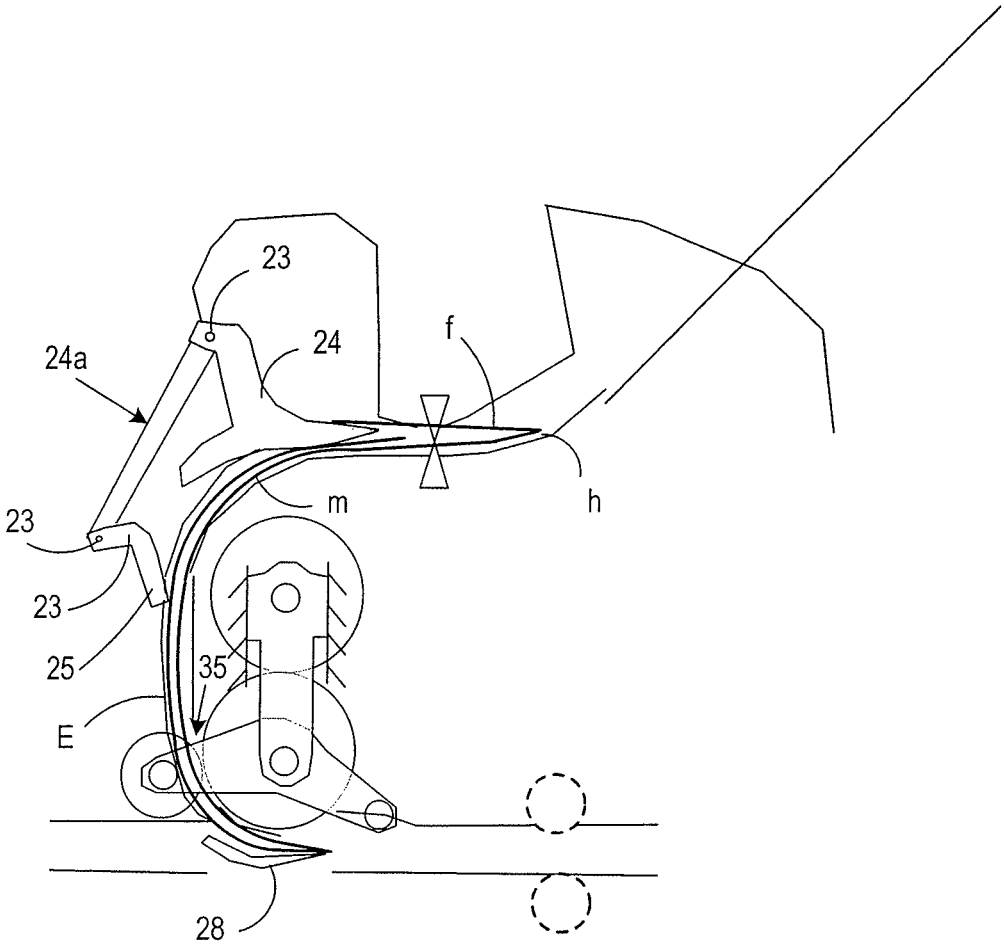
FIG. 6 is a close-up view showing the flap opening operation of FIG. 5 in more detail.

As shown in FIG. 5, an envelope so received is fed along the envelope inlet feed path 26, between the fixed feed path guide plates 26*a* and 26*b*, so as to follow a curved path that brings the envelope through the flap securing location by causing the envelope to be fed between nip 35 formed between drive roller 32 and securing roller 34 at a point along the envelope inlet feed path 26. As shown in FIG. 5, as the envelope leading end proceeds along the envelope inlet feed path 26, it engages kicker link 25 of the flapper link mechanism 24*a*. With reference also to FIG. 6, it can be seen that as the envelope forces the toe of kicker link 25 out of the envelope inlet feed path 26, the rotation of kicker link 25 causes the flapper link mechanism 24*a* to be actuated, bringing the flapper 24 into the envelope inlet feed path 26. The flapper link mechanism 24*a* and the flapper 24 are so configured that, for envelopes above a certain size, the flapper 24 will be in the envelope inlet feed path 26 as the envelope flap f approaches the flapper 24. As shown in detail in FIG. 6, the flapper 24 becomes forced between the envelope main body m and the envelope flap f. As the envelope E is further fed around the envelope inlet feed path 26, through nip 35, driven by drive roller 32, the leading end of the envelope is directed by trap door 28 into the insertion location 30. At the same time, the envelope flap f is forced by flapper 24 upwardly out of the envelope inlet feed path 26, thereby obtaining an open configuration.

Figure 7:
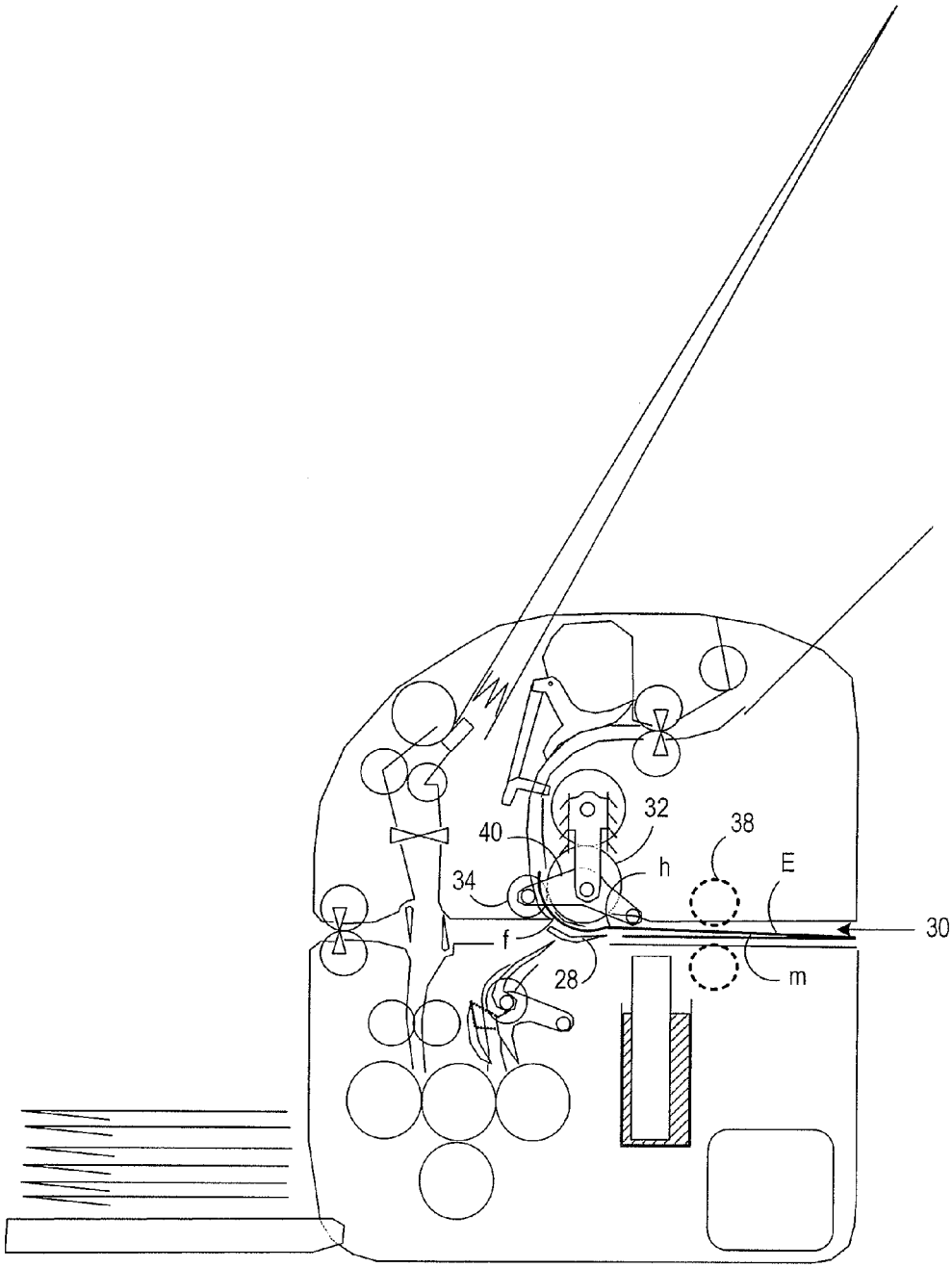
FIG. 7 is an internal cross-sectional view of the mail piece creation device of FIG. 1, showing the envelope at a flap securing position.
Figure 8:
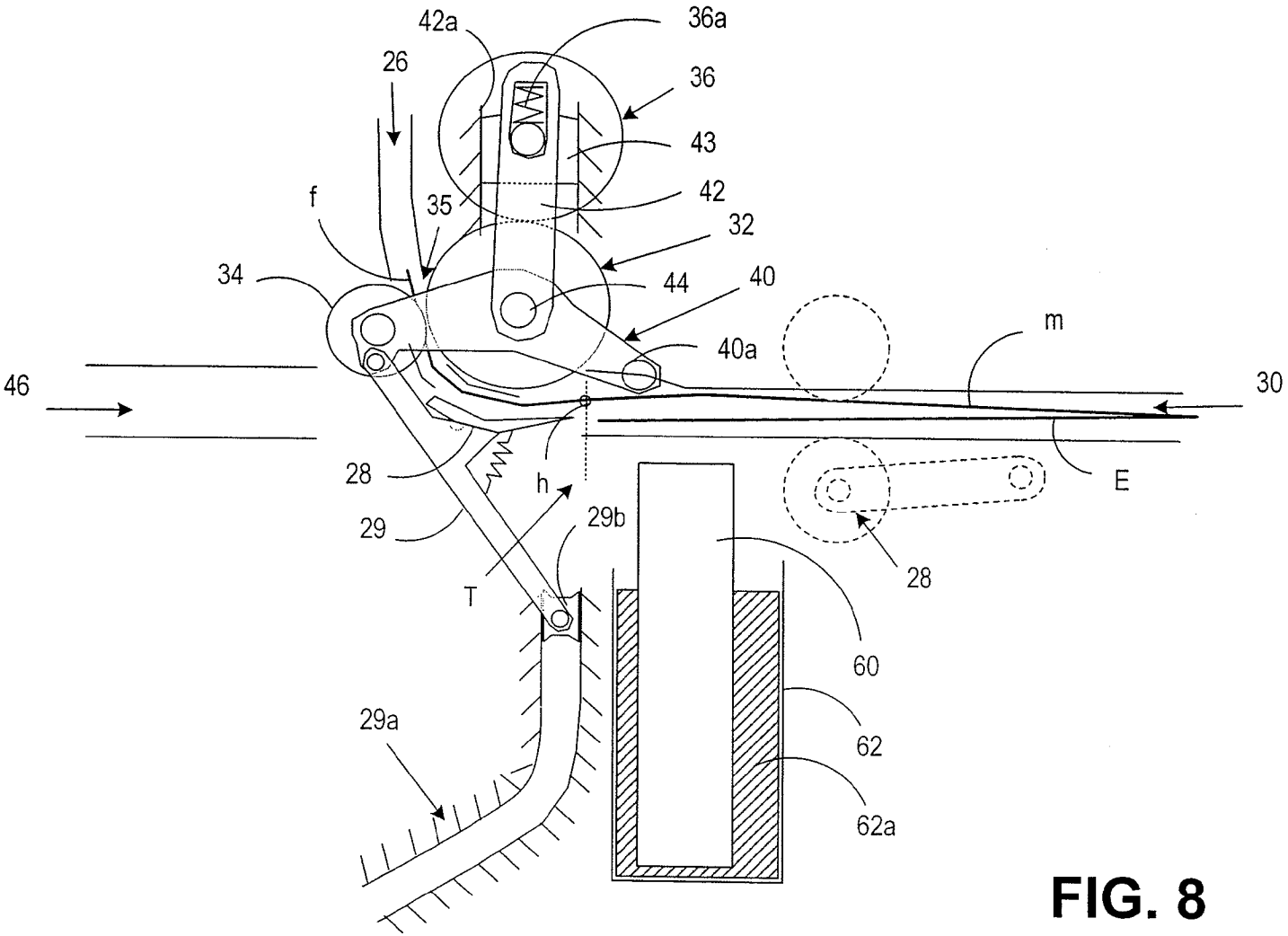
FIG. 8 is an internal cross-sectional view showing the envelope at the flap securing position, and showing further details of the associated flap sealing apparatus.

Turning now to FIG. 7, there is illustrated the situation when envelope E has been fed further around the envelope inlet feed path 26, so that the main body m of the envelope E is substantially entirely located within the insertion location 30. The envelope may be driven into such a location by the drive roller 32, with assistance from insertion feed rollers 38 in the insertion location. Feeding of the envelope E is halted as the envelope hinge h approaches the hinge threshold T (see FIG. 8). In this location, the envelope flap f is retained in the nip 35 between drive roller 32 and securing roller 34. Due to rollers 32 and 34 being cooperatively mounted on a common securing support frame 40, the envelope flap f becomes securely held in the nip 35. This may be achieved, for example, by forming the rollers 32 and 34 with an appropriately small clearance, or by biasing the securing roller 34 towards drive roller 32. Referring to FIG. 8, the position of the envelope E shown in FIG. 7 is depicted in more detail.

As shown in FIG. 8, there is a hinge threshold T to or beyond which the hinge h must travel so as to ensure that the mouth of the envelope is properly received into the insertion location 30, to enable mail items to be inserted into the envelope.

FIG. 8 additionally illustrates an example of how the trap door 28 can be mounted onto a trap door frame 29, to thereby form a guide path for the envelope, in the position shown in FIG. 8, so as to direct the envelope from the envelope inlet feed path 26 into the insertion location 30. Trap door 28 is rotatably mounted onto the trap door support frame 29, biased in a clockwise direction as shown in FIG. 8. One end of the trap door support frame 29 is pivotally mounted to the securing support frame 40 to which drive roller 32 and securing roller 34 are commonly mounted. The other end of the trap door support frame 29 is mounted on a follower 29*b*, constrained to follow trap door frame guide path 29*a*.

In the embodiment shown, the flap f of the envelope E is held securely in the position shown in FIG. 8 by locking the drive roller 32 against rotation. This allows a mail item to be inserted into the envelope at the mouth, during an insertion operation.

Figure 9:
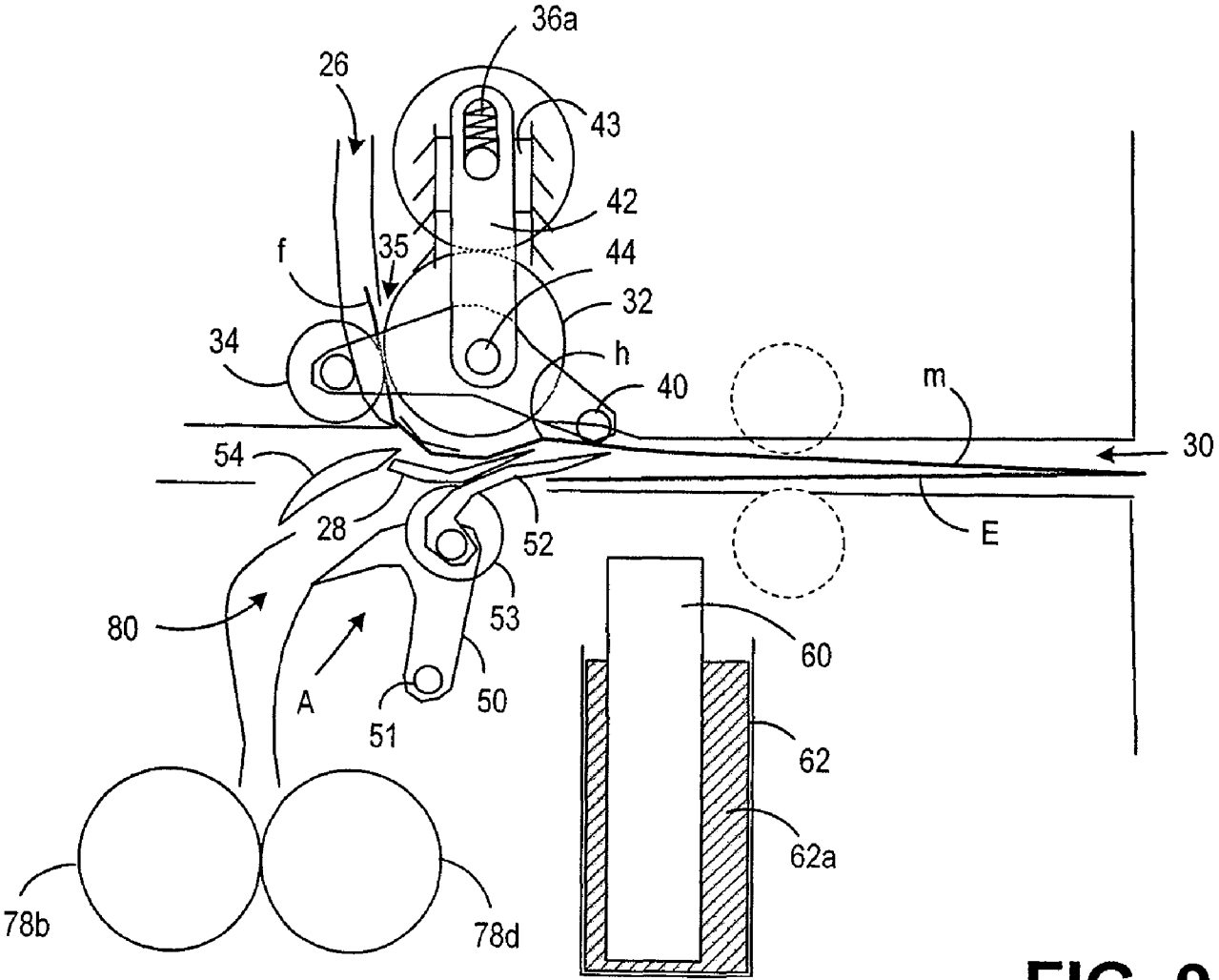
FIG. 9 is an internal cross-sectional view of the flap sealing apparatus of the mail piece creation device of FIG. 1, showing the envelope at the insertion position.

An insertion operation takes place with the apparatus in the configuration depicted in FIG. 9. Specifically, with the flap f held between drive roller 32 and securing roller 34, insertion frame 50 is rotated around pivot 51 so that the insertion fingers 52 extend into the mouth of the envelope E near to the envelope hinge h. This is achieved by the insertion fingers 52 forcing the trap door 28 into the feed path, against the trap door biasing force, so as to bring the insertion fingers 52 and insertion drive roller 53 into proximity with, and into, the open mouth of envelope E held in the insertion location 30. As shown, this rotation by the insertion frame 50 in the direction of arrow A about the pivot 51 brings the insertion guide 54 into alignment both with a sheet insertion path 80 and with an inlet opening formed between the trap door 28 and the insertion fingers 52. In this manner, folded sheets can be fed between roller pair 78*b* and 78*d*, along sheet insertion path 80, to be guided by insertion guide 54 between trap door 28 and insertion fingers 52, into the mouth of the envelope E. Insertion drive roller 53 is then able to fully drive the folded sheet into the envelope E, due to its proximity to the mouth of the envelope at the location of the hinge h.

Figure 10:
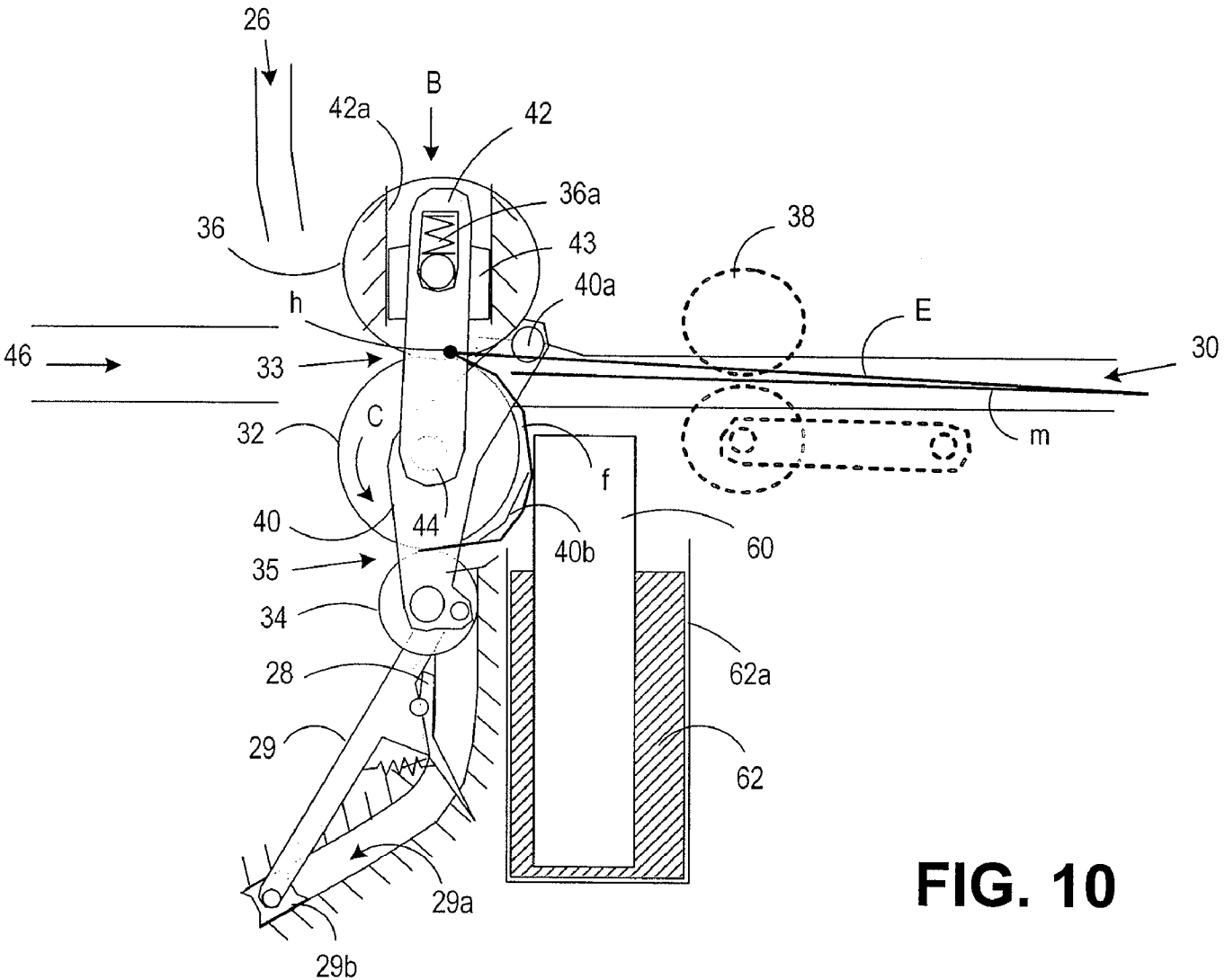
FIG. 10 is an internal cross-sectional view of the sealing apparatus of the mail piece creation device of FIG. 1, showing the envelope at the envelope sealing position, immediately prior to sealing the envelope flap.

With reference to FIG. 10, the filled envelope can then be sealed. To achieve this, the insertion frame 50 is first rotated in the direction opposite to arrow A in FIG. 9, away from the insertion location 30. The drive roller 32 is then moved from its position at the envelope flap securing location, where it was originally located, to an envelope sealing position. As shown in FIG. 10, the envelope sealing position is reached by moving the drive roller 32 substantially in the direction of arrow B. This takes the drive roller 32 from one side (the upper side, in FIG. 9) to the other side (the lower side, in FIG. 10) of the feed path 46, which is a continuation of the insertion location 30. As the drive roller 32 moves in the direction of arrow B, securing support frame 40 is caused to rotate about pivot 40*a*, giving rise to a relative rotation between drive roller 32 and securing roller 34 in the direction of arrow C around the axis 44. This causes the securing roller 34 to travel part way around the outer circumference of drive roller 32, as the drive roller moves in the direction of arrow B. This enables the end of the flap f to be retained securely between the drive roller 32 and securing roller 34 in the nip 35. To ensure that grip of the flap is not lost, an appropriate amount of rotation of the drive roller 32 may be allowed, in order to maintain the desired position of the flap f in the nip 35. As shown in FIG. 10, the rotation and downward motion of the drive and securing roller pair 32 and 34 brings the nip 33 of the drive and sealing roller pair 32 and 36 into the feed path 46 at the insertion location 30. Furthermore, the motion of the securing roller 34, constrained by the common securing support frame 40, assists in maintaining the hinge h at a desired location in the feed path 46, to thereby force the hinge h into the roller nip 33 between the drive roller 32 and sealing roller 36. As shown schematically in FIG. 10, the hinge h of the envelope E is thus positioned ready for sealing in the sealing nip 33.

As is further evident from FIG. 10, the motion of the drive and sealing roller pair 32 and 36 in the direction of arrow B is constrained both by the rotation of the securing support frame 40 about its pivot 40*a*, and by a follower portion 43 of the sealing support frame 42 being located within guide path 42*a*. Likewise, the follower 29*b* of the trap door support frame 29 is constrained to follow the trap door frame guide path 29*a*, as the other end supported by the common securing frame 40 is moved in the direction of arrow B while the support frame 40 is rotated in the direction of arrow C. This effectively brings the trap door out of the way of the feed path 46, during the transition.

In the configuration shown in FIG. 10, a moistening wick 60 is positioned adjacent to the drive roller 32 in the sealing position of FIG. 10. Because the flap is securely held in the nip 35 between drive roller 32 and securing roller 34, the flap f is also brought into proximity or contact with the moistening wick 60. The moistening wick 60 is located in a container 62 of moistening agent 62*a*, typically water.

To seal the envelope, drive roller 32 is driven in the direction of arrow C, to force the hinge h through the sealing nip 33. As shown, driving engagement is maintained by the sealing roller 36 being held in biased engagement with the drive roller 32 by biasing means 36*a*. As is evident, as the hinge h is fed through the sealing nip 33, the envelope E is driven along feed path 46. As the drive of the envelope E progresses, the flap f released from its held position in nip 35, due to rotation of drive roller 32, whereby the natural resiliency of the flap f brings the flap into contact with the moistening wick 60, to thereby moisten the gum on the envelope flap. As the flap f and main body m are fed through the sealing nip 33 by continued drive of the drive roller 32, the flap f is brought into pressing engagement with the main body m of the envelope E. This securely seals the envelope flap f against the envelope main body m. To assist in driving the envelope through the sealing nip 33, drive may be supplied from the insertion feed rollers 38. The envelope E is then fully fed through the roller nip 33 between drive roller 32 and sealing roller 36, along the feed path 46, as a completed mail piece M. Referring once more to FIG. 3, the completed mail piece M is received by ejection roller pair 13*a* and ejected from the mail piece ejection opening 13 onto the mail piece collection tray 9.

As an alternative to relying on the natural resiliency of the envelope flap f in order to moisten gum on the underside of the flap, the flap may instead be brought into positive engagement with the moistening wick 60. One method is to move the hinge threshold T, or to reduce the radius of drive roller 32, so that as the drive and sealing roller pair 32 and 36 moves to the envelope sealing position, with flap f securely held in the nip 35, a buckle forms in the flap f that brings it positively into contact with moistening wick 60. A further alternative is to provide a portion 40*b* of the feed path leading into the insertion location 30, mounted on the securing support frame 40 between the drive roller 32 and the position of the secured flap (see FIGS. 10 and 11). This portion 40*b* can be configured to press the flap f into engagement with the moistening wick 60 as the securing support frame 40 rotates to the envelope sealing position.

The envelope sealing apparatus, which includes the drive roller 32, sealing roller 36 and securing roller 34, mounted on common support frames 40 and 42, can then be returned from the envelope sealing position of FIG. 10 to the securing position of, for example, FIG. 3, ready to receive any further envelope.

Figure 11:
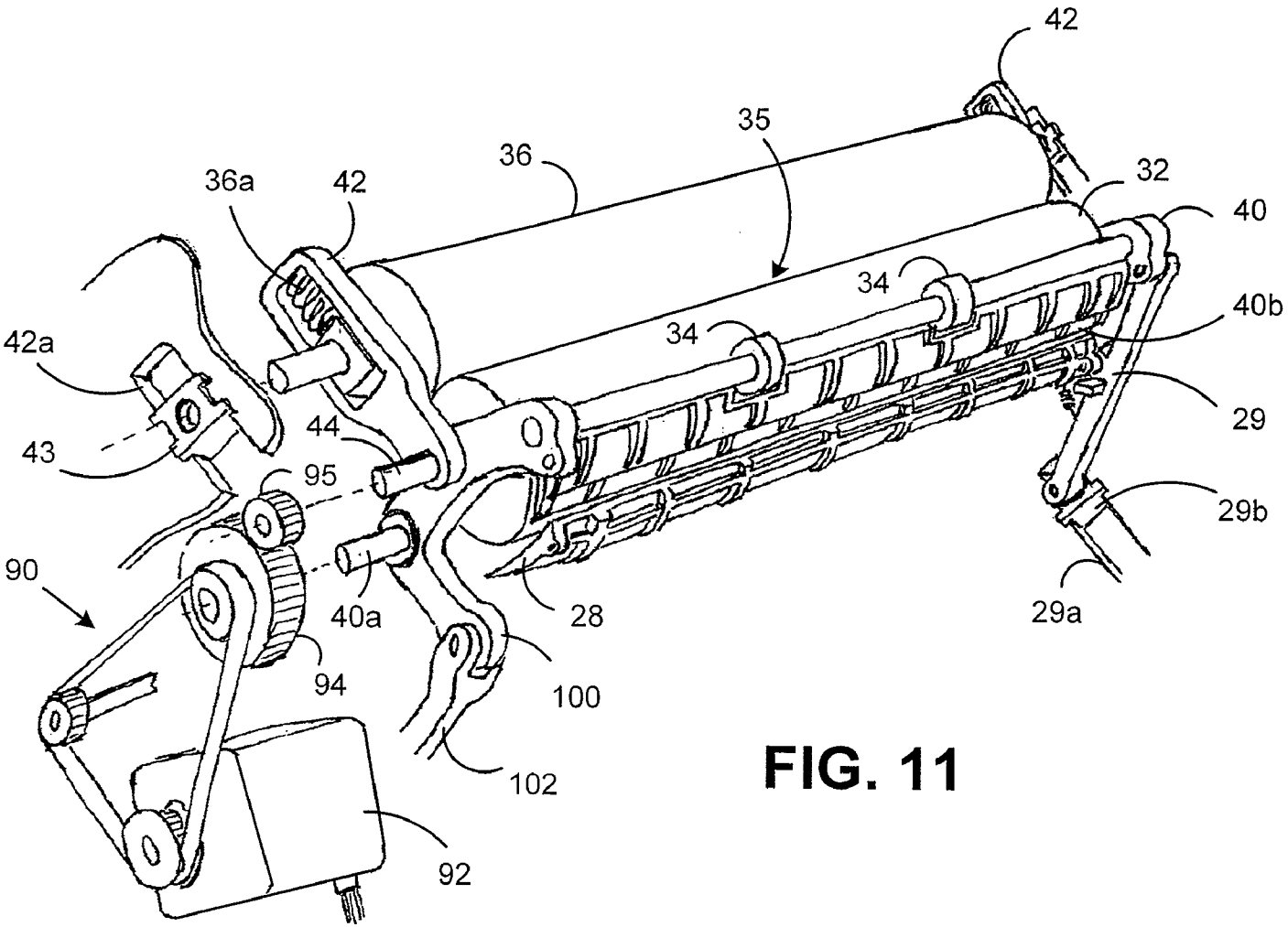
FIG. 11 is an internal perspective view showing the main components of the flap sealing apparatus and an associated drive mechanism.

Referring now to FIG. 11, the main components of the flap sealing apparatus are shown in perspective view, from the bottom-front-left-side of the mail piece creation device. From this view, the arrangement of the various rollers 32, 34, 36 on support frames 40, 42 can be seen.

In particular, it can be seen how sealing roller 36 is held in biasing engagement with drive roller 32 by biasing means 36*a* mounted in sealing support frame 42. On the right-hand-side of FIG. 11, the trap door support frame 29 is shown, including follower 29*b* in guide path 29*a*, for moving the trap door 28 out of the path of the flap sealing mechanism as it descends to the flap sealing position. The feed path portion 40*b* for pressing flap f into contact with moistening wick 60 (in selected embodiments) is also visible.

On the left-hand side of FIG. 11, detail of the sealing support frame 42 and how it is mounted to follower 43 to follow guide path 42*a* is shown. Guide paths 29*a* and 42*a* may simply be tracks formed in side plates that define the side edges of the paper feed paths, for example. Also shown, schematically, is a motor drive arrangement 90 for supplying drive from a motor 92 to the drive roller 32. Because gears 94, 95 are mounted coaxially with the pivot 40*a* of securing support frame 40 and axis 44 of drive roller 32, drive can be supplied from motor 92 to drive roller 32 at both the flap securing and flap sealing positions of the sealing mechanism, without requiring a complex drive-engaging mechanism, such as electronic clutches and the like.

It will further be apparent that the securing support frame 100 on the left-hand-side of FIG. 11 is shaped as a link mechanism, cooperating with actuating link arm 102, to move the sealing mechanism between the flap sealing position and flap securing position, differently from securing support frame 40 that is configured to (simultaneously) actuate the trap door 28 by moving trap door support frame 29. Any suitable means may be utilized to actuate link arm 102, although a preferred embodiment is cam-driven.

It will be appreciated that the envelope sealing apparatus described herein will be applicable to envelope sealing operations not restricted to the particular arrangement in the mail piece creation device herein described. For example, while the illustrated embodiment utilizes an insertion frame 50 and trap door 28 for inserting mail items into the envelope, such a configuration is not essential, and mail items may be inserted into envelope E along a different path, such as along feed path 46.

It is further to be noted that because the sealing apparatus is mobile from a flap securing position to an envelope flap sealing position, the envelope with mail item inserted therein is fed along a straight feed path from insertion location 30, through feed path 46 and out of mail piece ejection opening 13. This enables such an envelope sealing apparatus to be of particular use for sealing envelopes that contain rigid or non-flexible mail items. Such mail items might typically include, for example, CDs or DVDs, thick booklets, cardboard, and many other non-flexible mail items that one might wish to deliver by post.

Similarly, while the illustrated embodiment is suitable for inserting a single folded sheet into a single envelope, each fed from a respective stack, it will be appreciated that the mail piece creation device is not so limited. In particular, known mail piece creation devices include means for collating a plurality of sheets, folding these simultaneously, and inserting them into an open envelope. The envelope sealing apparatus disclosed herein would be suitable for inclusion within such a mail piece creation device.

Furthermore, it should be noted that specific components have been described which are useful for handling the envelope E in the described operation. However, flapper 24 and flapper link mechanism 24*a* would not be required at all in a device configured to receive envelopes that are provided in the open configuration, while moistening wick 60 and moistening agent container 62 would not be required for envelopes where it is not necessary to moisten the gum on the envelope flap. Envelopes are known, for example, containing gum portions on both the envelope flap f and envelope main body m that react when brought into mutual engagement so as to form a seal.

Additional modifications are also conceived, for the various components of the sealing apparatus. For example, the flap securing operation could be achieved using an appropriate electromechanical gripping apparatus, other than a securing roller 34. Likewise, an equivalent sealing operation may be achieved by using alternative cooperating feeding members, such as driving feed belts, to seal the envelope. This might be appropriate, for example, where it is required to fit the sealing apparatus into a mail creation device that has space only for a particular size or shape of sealing apparatus within the housing, within which to accommodate the apparatus.

It is, of course, also apparent that rather than proceeding to feed the sealed envelope along feed path 46, the finished mail piece could be ejected out of an opening at the end of insertion location 30, by reversing the feed motion of the drive roller 32 and feed roller pair 38, or equivalent driving means, after the sealing operation.

Although mail piece creation is described above firstly by reference to feeding and folding a sheet and secondly by reference to inserting such a sheet, as one example of a mail item, into an envelope, it will be apparent that the sheet handling and envelope handling steps set out above can be carried out simultaneously or in different sequences of operation, up until the point of inserting the sheet into the envelope prior to sealing. The sequences of such operation are thus open to preference.

Accordingly, it is to be understood that the present invention is defined by the scope of the appended claims. The accompanying drawings are merely illustrative, by way of example, and not limiting of the scope of protection.

By utilizing the sealing apparatus and associated method of the present invention, the size of a sealing apparatus and associated mail piece creation device can be reduced, by reducing the amount of motion that the envelope to be sealed must undertake. Furthermore, the sealing apparatus can be utilized for sealing mail pieces including mail items that are thick, non-flexible or rigid, where the mail item could not be fed around a curved path.

What is claimed is:

1. An envelope sealing apparatus for sealing an envelope having a main body and a sealable flap at one end of the main body foldable about a hinge between the flap and main body, the flap being sealable to said main body under applied pressure when folded about said hinge into contact with the main body, the apparatus comprising:

A. a feed path along which an envelope can be fed;

B. driving means associated with said feed path for, at least in part, feeding an envelope along said feed path;

C. flap securing means cooperative with said driving means to secure an open envelope flap in contact with the driving means; and D. flap sealing means cooperative with said driving means to seal the flap to the main body when the driving means drives the envelope in a flap sealing direction along the feed path, wherein said driving means is movable from a flap securing position to a flap sealing position, the driving means being operable:

I. to secure an open envelope flap in contact therewith cooperatively with said flap securing means while in the flap securing position;

II. to move from the flap securing position to the flap sealing position with the flap secured in contact therewith, so as to at least partially fold the flap about the hinge; and III. thereafter to drive the envelope in the flap sealing direction along the feed path, so as to seal the flap to the main body by applying pressure cooperatively with said flap sealing means while in the flap sealing position, wherein the size of the sealing apparatus is reduced by integrating the driving means with the flap securing and sealing means.

2. The envelope sealing apparatus according to claim 1, wherein said driving means is movable from a flap securing position on one side of the feed path to a flap sealing position on the other side of the feed path.

3. The envelope sealing apparatus according to claim 1, wherein said driving means and said flap securing means are mounted on a common securing support structure, so that as the driving means moves from the flap securing position to the flap sealing position, the flap securing means is supported to effect a complementary motion to ensure that an envelope flap thereby secured is maintained in contact with the driving means through at least a substantial portion of the motion.

4. The envelope sealing apparatus according to claim 1, wherein said driving means and said flap sealing means are mounted on a common sealing support structure, so that as the driving means moves from the flap securing position to the flap sealing position, the flap sealing means is supported to effect a complementary motion to ensure that, at the flap sealing position, an envelope driven in the flap sealing direction along the feed path by the driving means is subjected to an applied pressure.

5. The envelope sealing apparatus according to claim 1, further comprising a moistener adjacent to the flap sealing position, the moistener being configured and arranged to be capable of applying moisture to a portion of the flap prior to or during the envelope being driven in the flap sealing direction along the feed path.

* * * * *